United States Patent [19]

Johns, Jr.

[11] 3,965,587

[45] June 29, 1976

[54] QUICK DROP CONTROL FOR SCRAPERS

[75] Inventor: Robert C. Johns, Jr., Lubbock, Tex.

[73] Assignee: Clark Equipment Company, Buchanan, Mich.

[22] Filed: Nov. 13, 1974

[21] Appl. No.: 523,307

[52] U.S. Cl. ..... 37/8; 37/126 A; 91/436; 37/DIG. 1

[51] Int. Cl.[2] ..... B60P 1/36; F15B 11/08

[58] Field of Search ..... 37/127, 126, 129, 118, 37/8; 91/436

[56] References Cited

UNITED STATES PATENTS

| | | | |
|---|---|---|---|
| 3,568,707 | 3/1971 | Shore | 91/436 X |
| 3,604,313 | 9/1971 | Fruehauf | 91/436 X |
| 3,633,461 | 1/1972 | Komatsu-shi et al. | 91/436 |
| 3,786,827 | 1/1974 | Berg | 91/436 X |

*Primary Examiner*—Stephen C. Pellegrino
*Attorney, Agent, or Firm*—Kenneth C. Witt

[57] ABSTRACT

An hydraulic control, especially for tractor scrapers, having a quick action capability employing a pilot fluid to unseat a holding valve initiating the release of high pressure exhaust fluid from a cylinder which is recirculated to the opposite end of the cylinder to obtain a regenerative effect providing a quicker action than the normal movement.

2 Claims, 2 Drawing Figures

QUICK DROP CONTROL FOR SCRAPERS

BACKGROUND OF THE INVENTION

The invention pertains to mobile earth moving machines and more particularly to tractor scrapers with hydraulic controls raising and lowering the scraper bowl.

1. Field of the Invention

The raising and lowering of the scraper bowl is performed by a pair of hydraulic cylinders supporting the front of the bowl. The cylinder rods are extended to drop the bowl lowering the scraper blade into digging engagement with the ground or retracted to lift the bowl for hauling. When dumping, the bowl is partially lowered, the load is pushed out, and the dirt spread over the ground at a relatively uniform depth.

2. Description of the Prior Art

A control for operating the bowl cylinders will have a valve spool which is positioned to direct hydraulic fluid either to the rod ends of the cylinders for lifting the bowl or to the piston ends for lowering the bowl. A quick drop function can be provided as a separate lowering action by utilizing a separate valve spool and source of fluid under pressure which delivers an extra volume of hydraulic fluid to the cylinders causing them to rapidly extend when it is desired to lower the bowl quickly as may be the case when excavating between grade markers and stopping the machine each time to exactly position the blade would be too time consuming.

SUMMARY OF THE INVENTION

The present invention provides a control having a quick action feature employing a pilot fluid to unseat a holding valve initiating the release of high pressure exhaust fluid from one end of a cylinder. This fluid is returned through a main valve to the opposite end of the cylinder. Because of the loading on the cylinder, the exhaust volume and pressure are great enough to augment operation of the cylinder providing a quicker action than the normal movement.

In the particular case of a scraper control, a pair of pilot operated check valves hold the bowl cylinders up against the weight of the bowl. When the main valve is shifted to the quick drop position high pressure oil is delivered to the piston ends of the cylinders and at the same time pilot pressure opens the check valves. The exhaust fluid from the rod end is under high pressure because of the loading and smaller area on the rod side of the pistons. The exhaust fluid is returned to the piston side through the main valve providing an additional source of high pressure oil for rapid extension of the cylinders.

One advantage of the invention is the creation of a high pressure flow from the exhaust of a fluid motor which is used to intensify the work function by regeneration.

A special advantage for tractor scrapers is the utilization of a single valve spool, in combination with pilot operated check valves, to recycle exhaust fluid from the bowl cylinders to perform a quick drop function without need of a secondary source or separate valve.

These and other advantages will be more apparent by referring to the following description of a preferred embodiment which proceeds with a description of the drawings wherein:

DESCRIPTION OF THE PREFERRED EMBODIMENT

Figure 1:
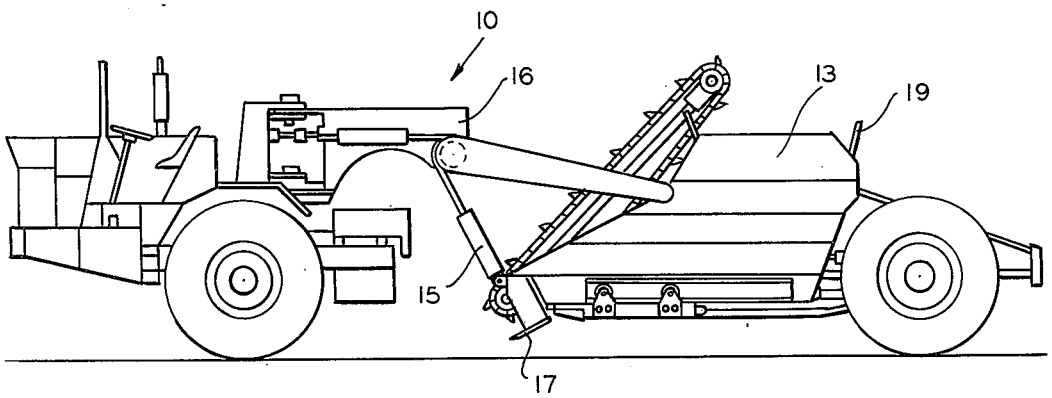
FIG. 1 is a side elevational view of a tractor scraper of a type which will utilize a quick drop hydraulic control.

FIG. 1 shows a tractor scraper 10 of the self-loading or elevating type, however, it will be appreciated that the invention applies equally to conventional scrapers in which the bowl is closed at the front by a pivoted apron; or to any other situation where quick cylinder action is desirable. In the scraper 10, the bowl 13 is supported by a pair of hydraulic cylinders 15 mounted on opposite sides of a yoke 16. The cylinders 15 will be extended to drop the front of the bowl so that a cutting blade 17 is lowered into digging engagement with the ground. The cylinders 15 can be retracted to raise the bowl for hauling the load and extended when dumping and spreading the load to any desired depth.

Figure 2:
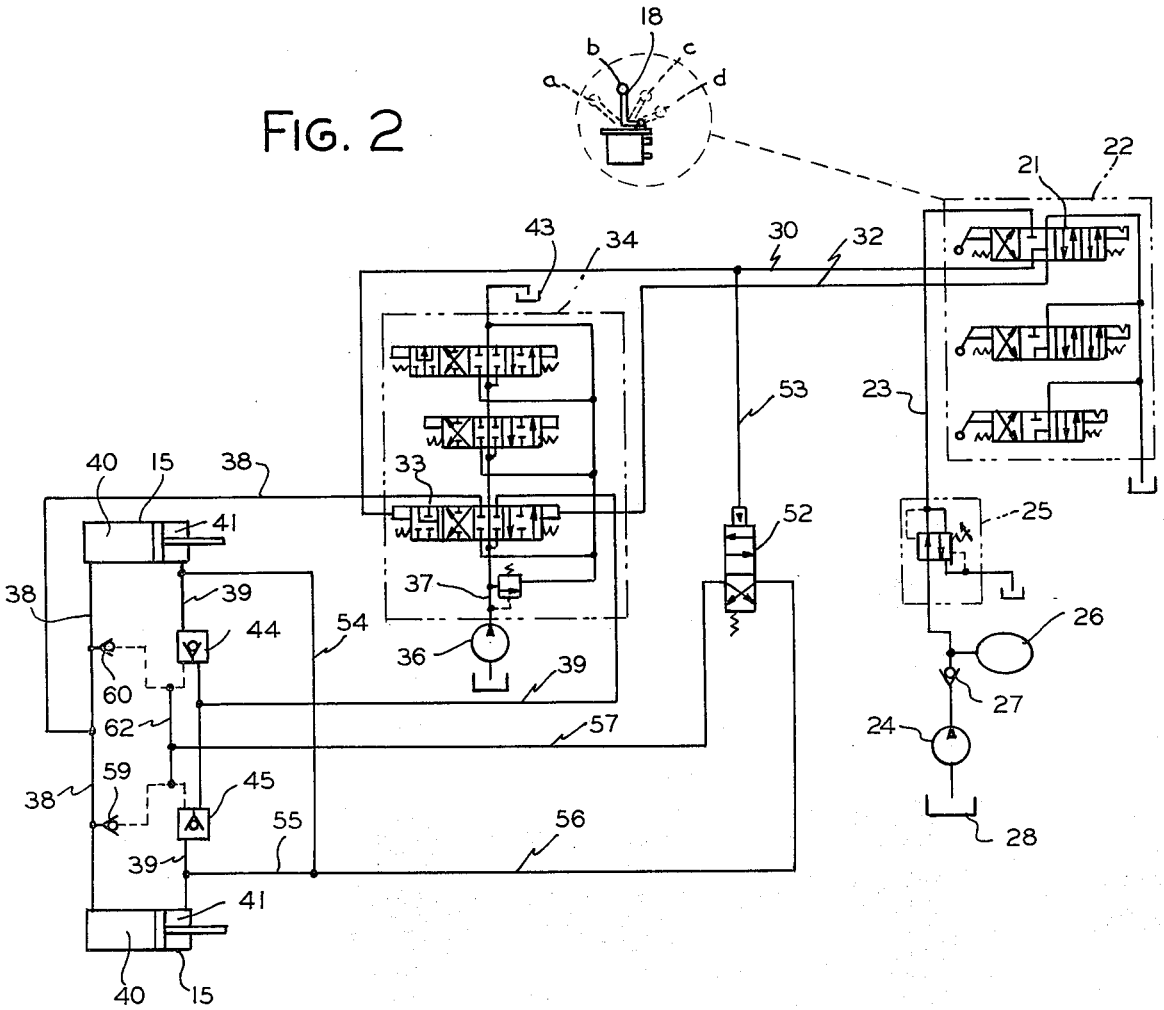
FIG. 2 is a hydraulic control circuit incorporating a quick drop feature according to the present invention.

FIG. 2 shows a hydraulic control for the bowl cylinders 15. A control lever 18 in the cab of the tractor can be moved to any one of four positions, *a*, *b*, *c* or *d* corresponding to up, neutral, down or quick drop functions which are performed by the bowl cylinders. The control lever 18 operates a four-position valve section 21 in a three sectioned control valve 22 supplied with hydraulic fluid through line 23 from a pump 24 through a pressure reducing valve 25 having a relief pressure setting consistent with the desired pilot pressure. An accumulator 26 is connected in the line 23 to allow the bowl to be lowered should the pump 24 be inoperative. The check valve 27 prevents fluid from the accumulator from flowing back through the pump 24 to the reservoir 28. The accumulator 26 is precharged to a higher pressure than the relief setting of the pressure reducing valve 25. The outer sections of the valve 22 are used for operating additional functions of no concern here such as an apron for a conventional scraper and an ejector or end gate, such as 19, which pushes the load out of the bowl.

Lines 30, 32 connect control valve section 21 to opposite ends of a valve section 33 of a main valve 34 having three valve sections corresponding to the valve sections in control valve 22. High pressure hydraulic fluid from a pump 36 is supplied through a line 37. The valve section 33 has positions corresponding to those of the control valve section 21 so as to direct the high pressure fluid from the pump 36 through lines 38 or 39 for pressurizing the piston ends 40 or rod ends 41 of the bowl cylinders for lowering or raising the bowl.

In the neutral or *b* position of the control lever 18, lines 30, 32 are not pressurized and the main valve section 33 remains in the neutral or open-center position whereby fluid from pump 36 flows through the valve 34 to a reservoir 43.

When the control 18 is moved to a position *a*, or the raise position, the valve spool in the section 21 is shifted so as to connect lines 23 and 32 causing pilot pressure to be delivered to the right side of the valve spool of the section 33 and cause it to move to the corresponding raise position. This connects line 39 to line 37 and the source of high pressure from pump 36. Hydraulic fluid is delivered by the line 39 to unseat a pair of check valves 44, 45 each of which opens to permit the fluid to flow to the rod ends 41 of the cylinders. Hydraulic fluid in the piston ends 40 escapes through line 38 back to the main valve and then to the reservoir 43.

In connection with the quick drop and lowering functions, a four-way, pilot operated valve 52 is connected by a line 53 to the pilot pressure line 30. The pilot operated valve 52 is actuated when the control valve section 21 is in either the down or quick drop positions of the control lever 18 corresponding to the positions *c* or *d* shown in FIG. 2. In the down or *c* position, the control valve section 21 is shifted so as to connect the pilot pressure from the pmp 24 in line 23 with the line 30. This delivers pilot pressure to the left side of the valve spool of section 33 causing it to be shifted to the corresponding lowering position. This in turn connects the high pressure output of pump 36 in line 37 to the line 38 delivering high pressure fluid to the piston ends 40 of the bowl cylinders. This pressure simultaneously acts on check valves 59, 60 and helps open the pilot operated check valves 44, 45 which are being opened also by the exhaust pressure flowing fro the lines 54, 55, 56, through the valve 52 and back through line 57 where it combines in line 62 with the high pressure fluid flowing through the check valves 59, 60 to open the pilot operated pump from check valves 44, 45. The exhausting fluid from the rod ends 41 of the cylinders flows through line 39, check valves 44, 45, which have been opened, back to the main valve section 33 and to the reservoir 43.

For quick drop, the control lever 18 is moved to position *d* which causes the valve spool in section 21 to shift to its fourth position (extreme right) which in turn causes the valve spool in section 33 to shift to a corresponding fourth position (extreme left) such that instead of connecting high pressure exhaust fluid from the rod ends 41 of the cylinders to the reservoir, it is recirculated through the line 38 so as to combine with the high pressure fluid from the pump 36 also delivered to the piston ends of the cylinders in that position of the valve. This step up in volume increases the stroke speed producing a quick drop action. This action is achieved without separate pumps or valves. The regenerative pumping action of the bowl cylinders is available because the cylinders are under load and the smaller area on the rod ends creates a pressure differential.

While one preferred embodiment of my invention has been disclosed it will be understood that the description is for purposes of illustration only and that various modifications and changes may be made without departing from the nature of the invention which is defined in the appended claims.

I claim:

1. In a mobile earth moving scraper, a bowl to hold, haul and dump earth material, an hydraulic cylinder operable to raise or lower the front of the a bowl, a blade on the front of the bowl engageable with the ground when the bowl is lowered for digging earth material to fill the bowl, the improvement comprising a control including a main valve having a valve spool shiftable from a neutral position to one of three fluid control positions corresponding to up, down or quick drop control functions of the hydraulic cylinders, a pump, a reservoir connected with the pump through the main valve with the valve spool in the neutral position, a first line carrying hydraulic fluid under pressure from the pump through the main valve when the valve spool is in the up position to one end of the hydraulic cylinder causing the bowl to be raised, a second line connecting the other end of said cylinder through the main valve with the reservoir when said valve spool is in said up position, a check valve in the first line checking any exhaust flow to the reservoir from the one cylinder end in the up position, a source of pilot pressure, a pilot operated valve connected to the source of pilot pressure in the down or quick-drop positions, a bypass line connected to said first line above the check valve directing exhaust cylinder flow from the one end of the cylinder through the pilot operated valve when actuated by the pilot pressure and returning it below the check valve to unseat it and allow flow through the check valve back to the main valve by said first line returning the exhaust flow to the reservoir in the down position of the main valve or recirculating it to the other end of the cylinder in said quick drop position.

2. A mobile earth-moving scraper according to claim 1 wherein the source of pilot pressure is a pump, a pilot main valve is connected to said main valve having a valve spool shiftable to one of three positions from neutral corresponding to up, down or quick-drop positions, a pilot pressure line connecting the pilot main valve to said main valve for shifting the main valve to said up position, another pilot pressure line connecting the pilot main valve to the main valve in the down and quick-drop positions and a branch line connecting the latter line to operate said pilot operated valve.

* * * * *